United States Patent [19]

Willmouth

[11] Patent Number: 4,718,232

[45] Date of Patent: Jan. 12, 1988

[54] GRAVITY AND BUOYANCY DRIVEN POWER GENERATORS

[76] Inventor: Robert W. Willmouth, P.O. Box 19146, Washington, D.C. 20036

[21] Appl. No.: 921,269

[22] Filed: Oct. 21, 1986

[51] Int. Cl.[4] ..... F03B 17/02

[52] U.S. Cl. ..... 60/495; 290/1 R

[58] Field of Search ..... 60/495, 496; 290/1 R, 290/1 D; 417/337

[56] References Cited

U.S. PATENT DOCUMENTS 3,194,008 7/1965 Baumgartner ..... 60/495

*Primary Examiner*—Stephen F. Husar

*Attorney, Agent, or Firm*—Larson and Taylor

[57] ABSTRACT

An apparatus which generates electrical power from a combination of gravity forces and the inherent buoyancy of a hollow body immersed in a fluid is disclosed. The apparatus includes a long chain having a plurality of hollow buoyant elements attached thereto. The chain extends around a pair of sprockets and the buoyant elements are immersed in a fluid along the portion of the chain moving against gravity and the buoyant elements pass through an airspace along the portion of the chain moving with gravity. The combination of buoyancy and gravitational forces cause movement of the chain to thereby rotate the sprocket gears which are used to drive an electrical power generator. Also disclosed is a housing including a hatch assembly for the apparatus and a valve unit and an insulator for use with the apparatus.

23 Claims, 11 Drawing Figures

GRAVITY AND BUOYANCY DRIVEN POWER GENERATORS

FIELD OF THE INVENTION

The invention relates to a gravity and bouyancy driven power generating unit.

BACKGROUND OF THE INVENTION

There is a general need for alternate sources for power which are inexpensive to operate and efficient in operation. Prior art power generators tend to be highly inefficient and lose a great deal of the power generated before that power can be utilized. Additionally, there is a need for power generators type which require little maintenance, and, when maintenance is required, are easy to repair.

The prior art includes several examples of machines that utilize buoyancy, and/or gravity to generate power. Examples of prior art systems and devices which embody concepts relating to the present invention include: U.S. Pat. No. 3,412,482 (Kusmer); U.S. Pat. No. 1,708,807 (Tatay); U.S. Pat. No. 3,934,964 (Diamond); U.S. Pat. No. 3,194,008 (Baumgartner); Japanese Pat. No. 56-60855 (A); French Pat. No. 2,262,738; Belgium Pat. No. 562,833; French Pat. No. 542,768; French Pat. No. 2,344,727; and Netherlands Pat. No. 1654.

The Kusmer patent discloses a buoyancy demonstrating apparatus wherein a plurality of expansible and compressible gas chambers are provided around the periphery of an endless carrier which is immersed in water. The Tatay patent discloses an air and water power driven device which utilizes a plurality of floats which are mounted on a continuous chain and which pass through a tube of water to provide motion. The Diamond patent discloses a gravity-actuated fluid displacement power generator which employs a number of sealed piston-cylinder units submerged below the surface of a liquid and mounted on a rotational member suspended between two hubs. The Baumgartner patent discloses a positive buoyancy prime mover wherein rotary motion is derived from the buoyancy of a plurality of balls mounted at the end of spokes extending out from a central hub. Part of the device is submerged in a liquid. Belgium Pat. No. 562,833 discloses a machine including a series of cylindrical barrels mounted on a continuous chain whose path of travel extends below the surface of a fluid. Japanese Pat. No. 56006865 (Kondou) discloses a machine driven by the buoyancy of a plurality of buoyant objects mounted in a spoke-like pattern. In use, the device is immersed in liquid. French Pat. No. 2,344,738 (Ecal) discloses a motor comprising a plurality of air-filled hollow vessels for providing hydrostatic thrust. French Pat. No. 2,344,727 discloses a machine driven by water pressure which incorporates a plurality of gas filled floats attached to a rotating torus immersed in water. Netherlands Pat. No. NR 1654 discloses an endless chain which carries a plurality of pistons thereon. French Pat. No. 542,768 (Goize) discloses a machine utilizing a plurality of vessels mounted on a continous chain and passing through a tube of water.

SUMMARY OF THE INVENTION

The present invention concerns an apparatus which generates electric power from a combination of gravity forces and the inherent buoyancy of a hollow body immersed in a fluid. This is accomplished through the provision of a long continuous chain or carrier to which a plurality of hollow bouyant elements, e.g., hollow spheres, are attached along the length of the carrier. The chain or carrier extends around a pair of sprocket gears such that movement of the chain causes rotation of the gears. The carrier and bouyant elements are mounted in a housing which contains a liquid, preferably water, at the bottom thereof and includes an upright chamber or tube therein which is filled with the liquid. The chain extends up through the chamber filled with liquid and down the other side through an air space above the liquid in the housing. The buoyancy of the hollow spheres causes them to rise in the liquid chamber, while gravity will cause the hollow spheres after passing over the top of the chamber through the air space into the liquid to drop downwardly. Thus, the combination of bouyancy and gravity causes movement of the chain carrying the hollow spheres and thereby rotate the sprocket gears driven by the chain. A gearing arrangement including take-off shaft driven by one of the gears is used to drive an electric generator to generate electricity.

In accordance with a further aspect of the present invention, a housing construction is provided which simplifies routine maintenance and repairs to the system. In addition, special valve units and insulators are provided which seal the housing against the passage of air while allowing entry of electrical components and compressed air or vacuum, as needed.

The valve unit includes a conically shaped closure member which fits snugly into a reciprocally shaped aperture which forms a valve seat. The conically-shaped closure member is biased shut by a spring and the valve unit also takes advantage of the pressure of the surrounding environment by using that pressure to aid in sealing the valve closure member in the closed position. The valve is opened by exerting a greater pressure on the opposite side of the conically-shaped member and thereby forcing that member out of contact with the walls of the aperture.

The insulator is designed to allow passage of electrical wiring while maintaining the integrity of the generator housing, and incorporates a number of important features which are discussed below.

A further important feature of the present invention concerns a hatch assembly for permitting entry to the housing chamber. This hatch assembly includes a locking mechanism which cannot be opened without releasing the pressure inside the housing chamber. This is a safety feature which prevents injuries which could result from opening the hatch because of tremendous pressure being exerted from below. The hatch assembly includes a concave door which aids in distributing the pressure over the hatch assembly so as to avoid significant stresses on any particular part of the hatch assembly. The concave shape also strengthens the hatch assembly against the pressure exerted thereupon.

It is an object of the present invention to convert the buoyancy of hollow spheres into a useful source of electric power.

It is another object of the present invention to employ gravity to generate electric power.

Still another object of the present invention is to provide an electric generator system which is easy to maintain and repair.

Still another object of the present invention is to provide a valve member that uses surrounding pressure to aid in sealing the valve shut.

Yet another object of the present invention is to provide an insulator which allows passage of electrical wiring while maintaining the integrity of the generator housing.

Yet another object of the present invention is to provide a hatch which cannot be opened without releasing the internal pressure which bears upon said hatch.

A still further object of the present invention is the provision of a concave hatch assembly which distributes high pressure evenly about the hatch and aids in strengthening the hatch against the pressure exerted thereupon.

Another object of the present invention is to provide a platform which is similar in construction to a fire escape landing that serves the dual purpose of providing workmen access to the generator components, while allowing pressurized air to pass therethrough.

Other objects, features and advantages of the invention will be set forth in, or apparent from, the detailed description of the preferred embodiments found below.

DESCRIPTION OF THE PREFERRED EMBODIMENT

Figure 1:
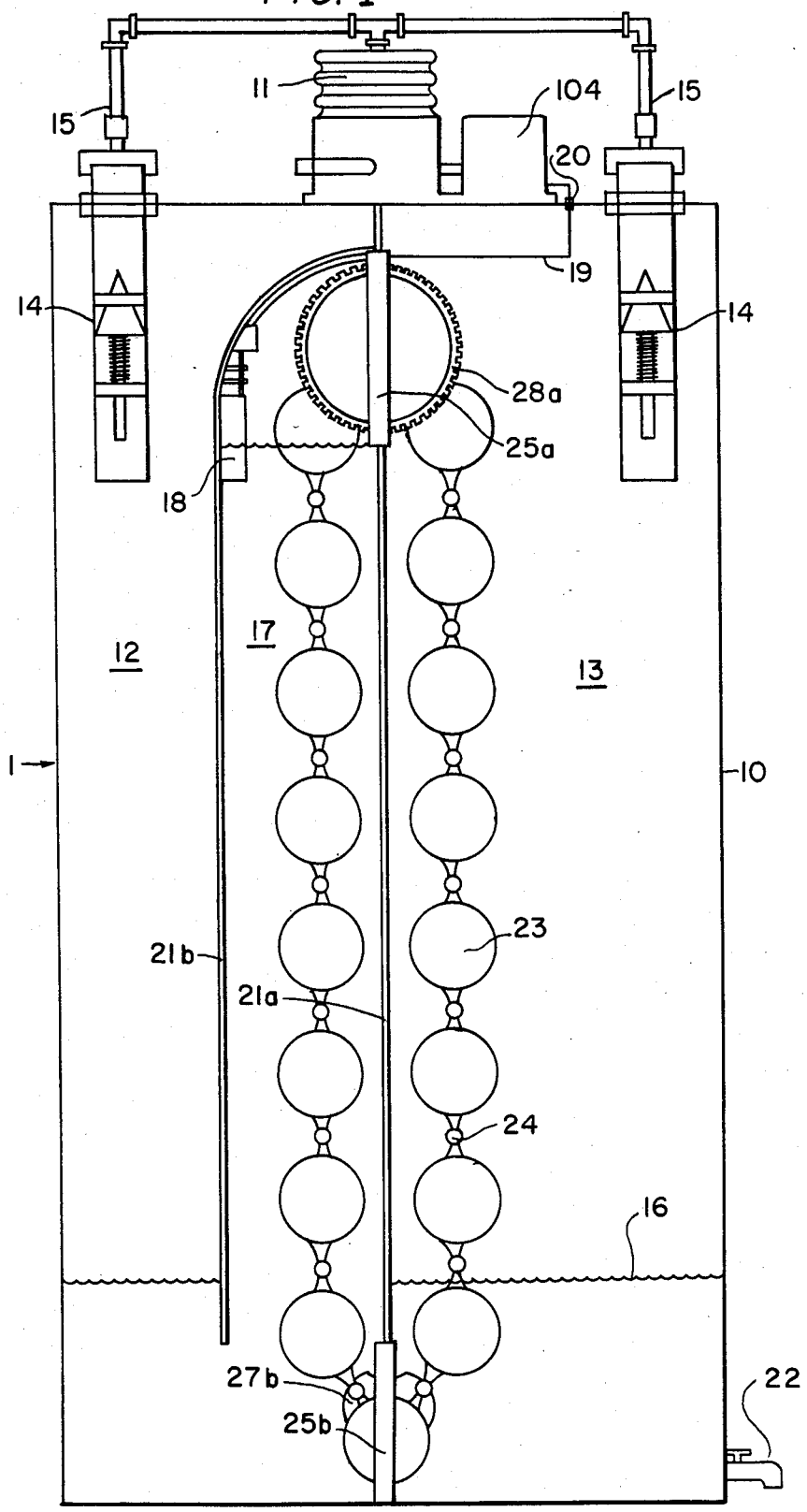
FIG. 1 is a side elevational view, partially in section of the power generating unit of the present invention.

As discussed above, the present invention relates to an apparatus or unit for generating power which employs a combination of water buoyancy and gravity to generate electricity. Referring to the drawings, as shown in FIG. 1 the unit, which is generally denoted 1, includes an airtight housing 10 which completely encloses the basic operating mechanism. On the top of the housing is a compressor 11 which, in a preferred embodiment, applies pressure to a pair of he chambers 12 and 13 formed within housing 10, through a pair of valve members indicated at 14. As discussed below, the points where the valve members 11 penetrate the housing 10 are constructed to be airtight, and the valve members 14 are themselves shown in more detail in FIG. 4. The pressure is applied to the chambers 12 and 13 is transmitted from the compressor 11 through a pair of associated pipes 15 and the valve members 14.

When the power generating unit 1 is initially prepared for operation the compressor 11 is manually turned on using a switch 100 and powered from a standard external power source. In the specific exemplary embodiment under consideration, there is initially 7 feet of liquid, e.g., water, 16 present in the bottom of the housing 10. When the compressor 11 is energized pressure is applied to chambers 12 and 13 through the valve members 14. This pressure acts on the surface of the water 16 in housing 10 and forces the water 16 up a central tube or chamber 17 as is shown in FIG. 1. Housing 10 is divided into chambers 12 and 13 by a central partition 21*a* which extends to the top of the housing 10 but which does not extend all the way to the bottom of the housing 10. Partition 21*a* forms one wall of chamber 17 while the three remaining walls, denoted 21*b*, define an elongate passageway which is curved at the top as indicated in FIG. 1. The bottom edges of walls 21*a* and 21*b* extend down below the surface of the water 16 both before and after pressurization of the generator.

A float switch 18, located near the top of chamber 17 and connected to the compressor 11 by an electrical connection 19, is responsive to the water level in the chamber 17. In particular, when the water 16 reaches a preselected level in the chamber 17, float switch 18 is actuated and shuts down the compressor 11. The connection 19 between switch 18 and compressor 11 extends through an airtight insulator 20 in the upper wall of housing 10. Insulator 20 is shown in more detail in FIG. 8.

Figure 2:
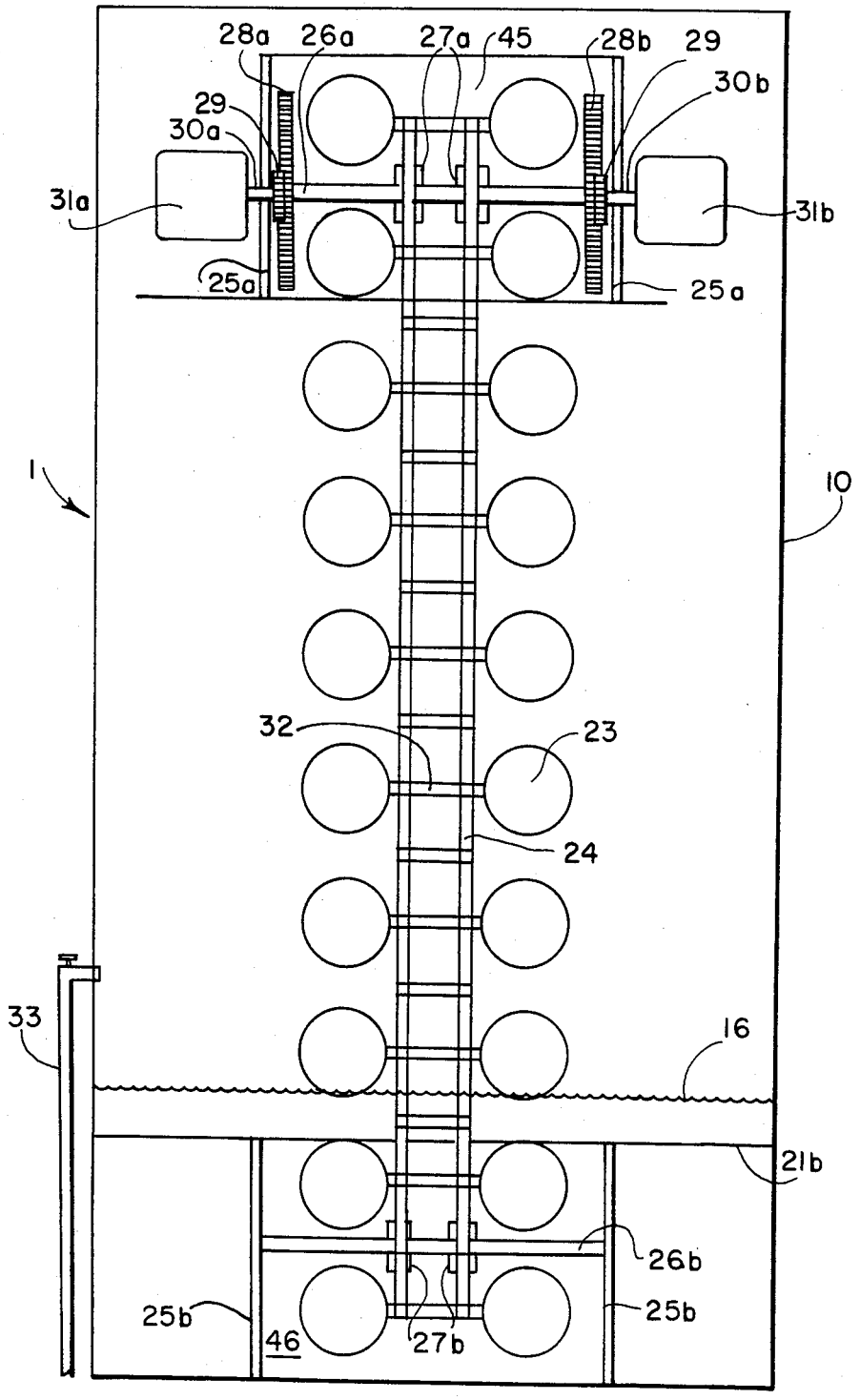
FIG. 2 is a front elevational view of the power generating unit of the present invention, including representative dimensions in accordance with a specific embodiment of the invention.

Once the chambers 12 and 13 have been initially pressurized the manual switch 100 is turned off and the compressor 11 is be operated solely by the float switch 18 and power for the compressor 11 is derived from the output of unit. The housing 10 includes a drain device 22 which is used to drain the water out of the housing 10 when necessary. As shown in FIG. 2, a fluid inlet pipe 33 is also provided which is used to fill the housing 10 with water 16.

The basic power generating mechanism of unit 1 includes a number of hollow balls or spheres 23 which are attached to a continuous double sided chain or carrier 24. Pairs of hollow balls 23 are attached to the chain 24 by a rod 32 at equally spaced locations therealong as shown in FIG. 2. The chain 24 is entrained about and extends around upper and lower pairs of sprocket gears or sprockets 27*a* and 27*b* which are mounted on respective axles 26*a* and 26*b*. Axles 26*a* and 26*b* are journalled for rotation in bearings (not shown) supported by upper and lower pairs of upright supports or frames 25*a* and 25*b* (see FIG. 2). With this arrangement, movement of the chain 24 will cause rotation of axles 26*a* and 26*b* and rotation of axle 26*a* will cause rotation of a pair of large gears 28*a* and 28*b* mounted at the ends thereof. A pair of smaller diameter, driven gears 28*a* and 29*b* are mounted on corresponding shafts 30*a* and 30*b*. Rotation of the small gears 29*a* and 29*b* causes shafts 30*a* and 30*b* to rotate, the respective gears meshing to convert the relatively slow rotation of the axle 26*a* into relatively fast rotation of the shafts 30*a* and 30*b*. As shown in FIG. 2, the shafts 30*a* and 30*b* are connected to a drive pair of electric generators 31*a* and 31*b* which convert the rotation of the shafts 30*a* and 30*b* into electrical energy.

Figure 3:
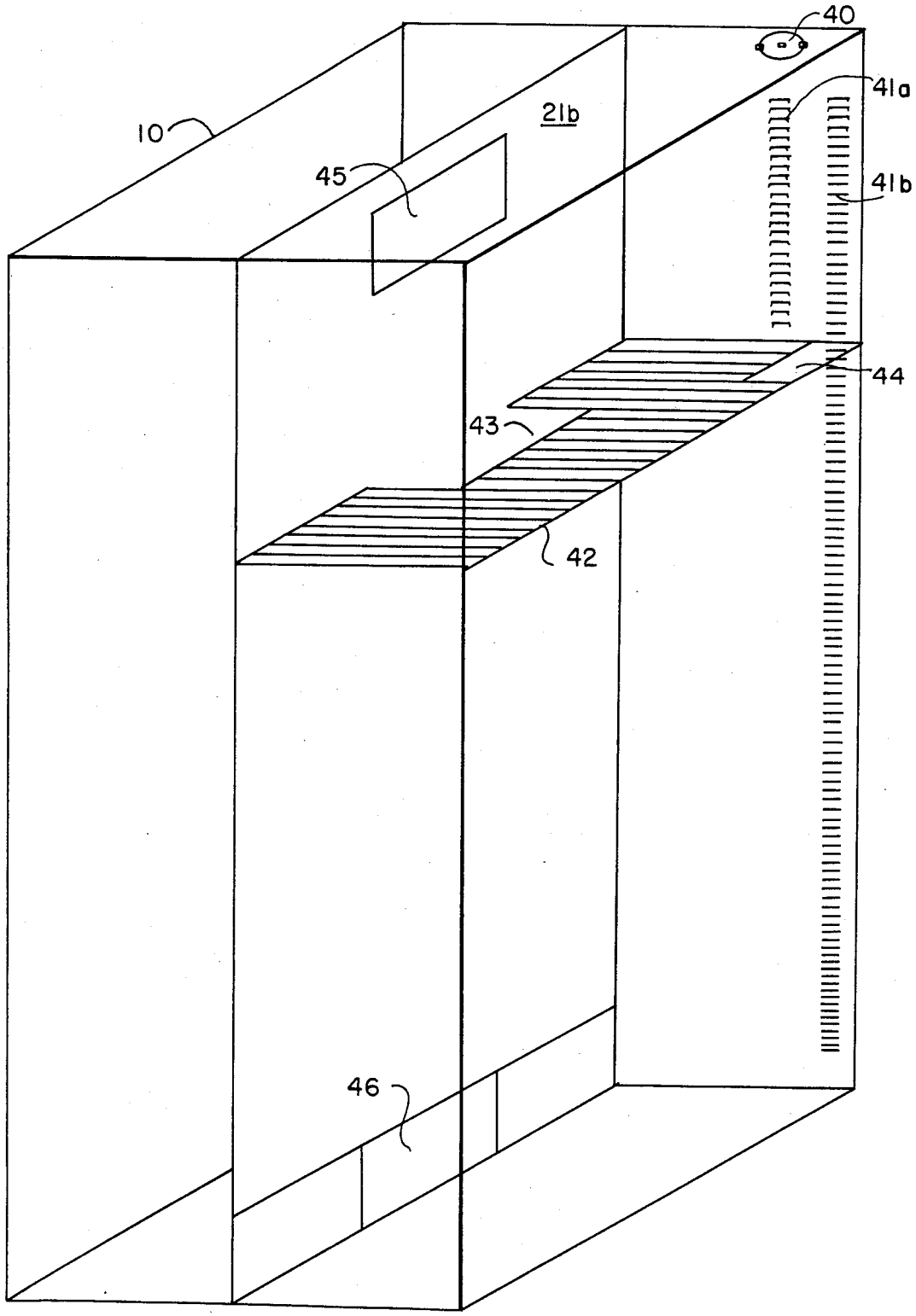
FIG. 3 is a perspective view of the housing for the unit with the operating mechanism omitted for purposes of illustration.

Referring now to FIG. 3, some of the salient features of the invention which are not seen in FIGS. 1 and 2 or which have been omitted for purposes of clarity, are illustrated. As illustrated, the housing 10 includes a hatch 40 which allows for entry of workmen to assemble the generator and to make repairs thereto. The hatch 40 is described below and is shown in more detail in FIGS. 6 and 7. In addition, there are two ladders 41*a* and 41*b* for workmen to gain access to upper and lower leves of the chamber 10 from the hatch 4. A further ladder (not shown) is located on the opposite side of the housing 10 from the other two ladders 41*a* and 41*b*. A platform 42 is provided at the upper level and the workmen are able to gain access to the platform 42 by using the ladders 41*a*. The platform 42 contains two openings 43 and 44 therein. Opening 43 is used to permit the hollow balls 23 and chain 24 to pass therethrough, while opening 44 allows workmen to climb down the ladder 41*b* which goes to the bottom of the housing 10. The platform 42 is an open framework similar construction to a fire escape landing and, in particular, is constructed of metal bars or grating having a plurality of openings therein to allow the passage of air through the platform. One side of the platform 42 is attached to the partition wall 21*b*. The wall 21*b* itself has two openings or apertures 45 and 46 therein (also seen in FIG. 2) at the top and bottom thereof. The top of the chain 24 with the attached hollow balls 23 pass through the upper aperture 45 in the wall 21*b* while the bottom of the chain 24 with the attached hollow balls 23 pass through the lower aperture 46 in the wall 21*b*.

Figure 4:
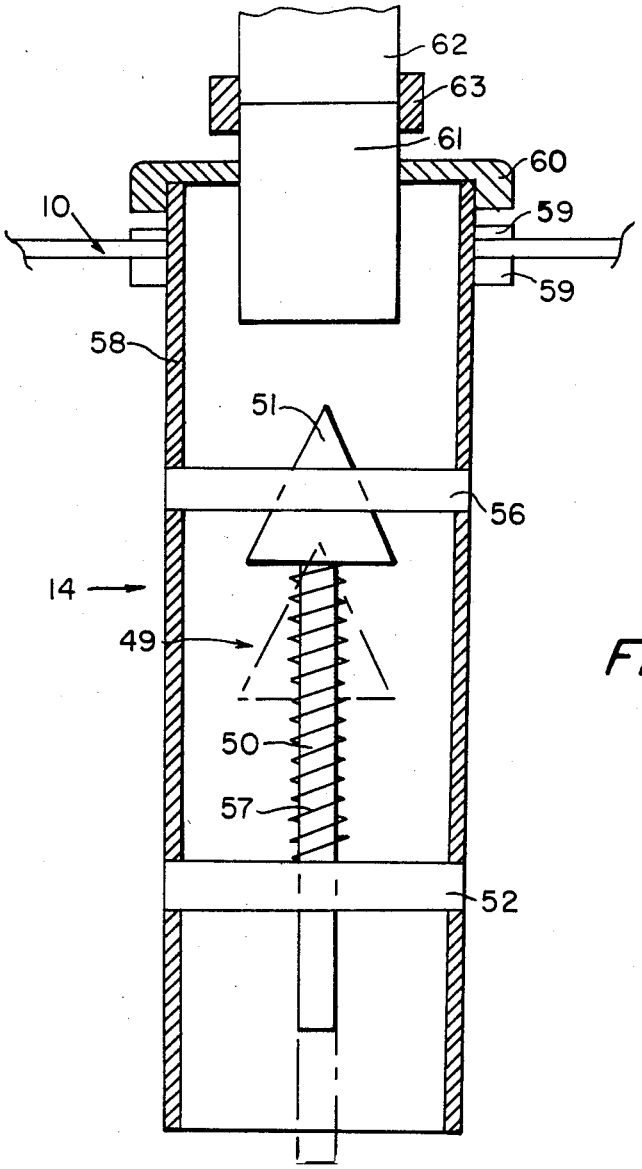
FIG. 4 is a longitudinal cross-section of a valve unit of the present invention.
Figure 5A:
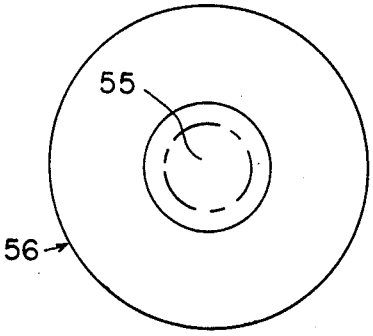
FIGS. 5*a* and 5*b* are plan views of plates incorporated in the valve shown in FIG. 4.
Figure 5B:
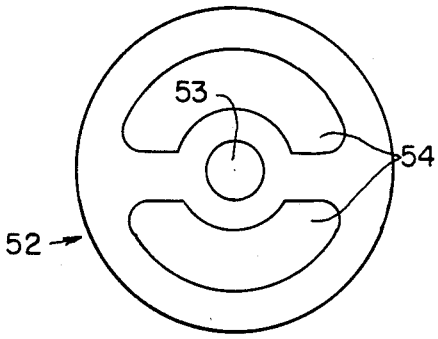

The automatic valve 14 referred to above is shown in more detail in FIGS. 4, 5*a*, and 5*b*. The valve is comprised of an "arrow" shaped valve member 49 having a cylindrical shaft 50 and a conical head 51. In the specific exemplary embodiment under consideration, the shaft 50 is preferably 3 inches long and ¼ inch in diameter. The cylindrical shaft 50 is guided by a circular plate 52 which has a circular aperture 53 in the center thereof. The cylindrical shaft 50 fits snugly through the circular aperture 53 which has a diameter of ⅝ inch. The circular plate 52 also has two other apertures 54 therein which allows fluids to pass through unobstructed. The head 51 of the arrow-shaped member 40 is conical in shape and fits snugly into a central aperture 55 of the plate 56. The conical head 51 is 1 inch in diameter and 1 inch long and the central aperture 55 is ½ inch in diameter at the to and ¾ inch at the bottom. The plate 56 is ¼ inch thick. The valve member 14 is shown in the open position by the dotted lines. Pressure exerted from the top of the valve will force the head 51 out of the central aperture 55 and force the shaft 50 downward. A spring 57 is wrapped about the shaft 50 from the head 51 to the circular plate 52. This spring 57 biases the head 51 into the closed position until a force greater than that exerted by the spring 57 forces the valve member 14 open.

Also part of the valve member 14 is threaded pipe or housing member 58 which serves to contain the valve member 14. The threaded pipe 58 penetrates the housing 10 and a pair of large washers 59 screw on the pipe 58 and make the junction between the pipe 58 and the housing 10 airtight. The threaded pipe 58 is preferably 2 inches in diameter and six inches long. A cap 60 screws over the top of the pipe 58 and contains a threaded circular hole in the center into which a second cylindrical pipe 61, which is also threaded on the outside, may be inserted. This second pipe 61 is attached to a length of standard pipe 62 by a standard coupling 63. The entire valve member 14 is designed to be airtight except when the valve is open.

One significant advantage of this valve member 14 is that the arrow always faces in the same direction as the existing pressure gradient such that the pressure will act against the bottom surface of the head 51 and aid in sealing of the valve. In this regard, where pressure is applied to the chambers 12 and 13 by the compressor 11 through the valve member 14 and the compressor 11 thereafter is shut down, the internal pressure within the chambers 12 and 13 will aid the spring 57 in providing sealing the head 51 in the aperture 55 in order to make the valve seal airtight.

Figure 6:
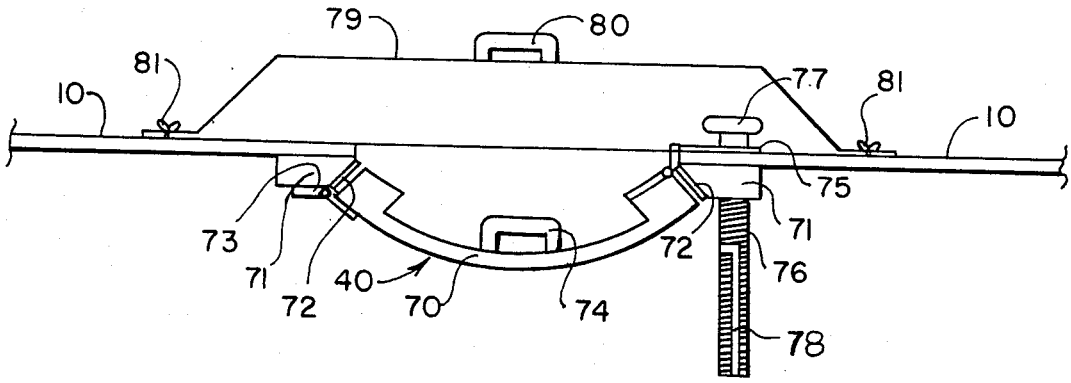
FIG. 6 is a cross-sectional side view of a hatch assembly constructed in accordance with the present invention and shown in the in closed position thereof.
Figure 7:
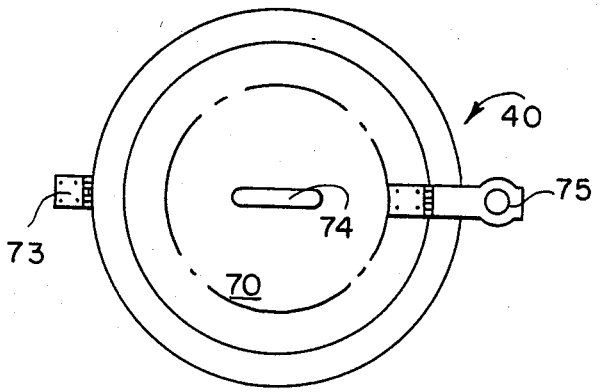
FIG. 7 is a plan view of the hatch assembly of FIG. 6.

Referring now to FIGS. 6 and 7, the constructional details of hatch 40, referred to above in connection with FIG. 3, are shown. As illustrated, hatch 40 is composed of a convex steel door 70 which fits into a doorframe 71. The doorframe 71 frames a corresponding opening in the upper wall of housing 10 and has a lead gasket 72 (which is 2 inches wide and ⅛ inch thick in an exemplary embodiment) glued on its surface. The door 70 abuts agains the gasket 72 and forms an airtight seal. The door 70 is convex and the internal pressure in the chamber 12 will act on the surface of the door 70 and aid in sealing the door shut. The door 70 is 36 inches in diameter and is 2 inches thick in the exemplary embodiment referred to. The door 70 is fastened to the doorframe 71 by a hinge 72. When the door 70 is opened the door swings downward into the chamber 12 on the hinge 73. A handle 74 is attached to the surface of the door 70 so that the door may be closed from outside of the chamber 12. The door 70 is secured shut by a hasp 75 which is hingedly attached to the door 70. This hasp 75 fits over a hole in the doorframe 71 and a large screw 76 (six inches long and ¾ inches in diameter, in an exemplary embodiment) is inserted through the hasp 75 and the hole in the doorframe 71 until the screw 76 extends well into the chamber 12. Screw 76 has a large head 77 which will not fit through the hasp 75 and thus acts to secure the hasp 75 to the doorframe 71. The lower portion of the screw 76 has a ¼ inch slot 78 therein which allows the screw 76 to function as a pressure release valve. The screw 76 must be removed, and the internal pressure consequently released, in order to open the door 70. In particular, when the screw 76 is unscrewed, a point will be reached where the top of the slot 78 will be disposed outside the chamber 12 and above the doorframe 71. This will allow the internal pressure within the chamber 12 to be released through the slot 78 into the surrounding atmosphere. Once the internal pressure has been released, the door 70 may be opened by completely removing the screw 76 from the hasp 75. Optionally, the hatch 40 may be enclosed by a cover 79 which has a handle 80 and is secured to the housing 10 by wing nuts 81.

Figure 8:
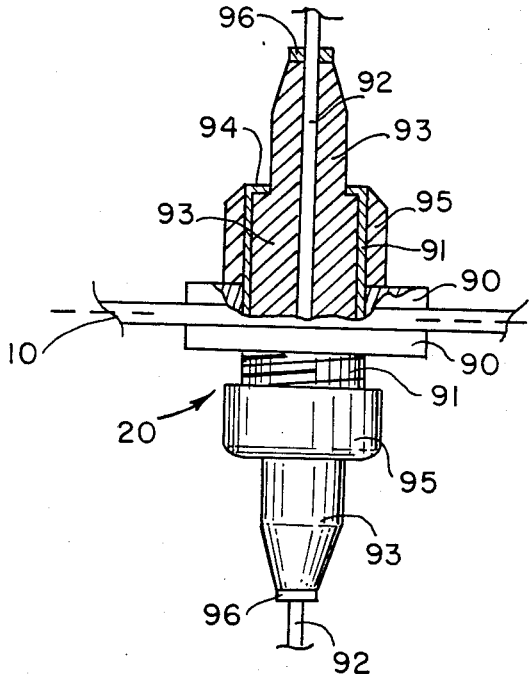
FIG. 8 is a side elevational view, partially in section, of an insulator constructed in accordance with the present invention.

Referring now to FIG. 8, constructional details of the insulator 20 (FIG. 1) as shown. As illustated, the insulator 20 includes two large insulator washers 90 (4 inches in diameter and ¼ inch thick, in an exemplary embodiment) and an insulator tube or housing pipe 91, (which is 3 inches in diameter, 6 inches long in this embodiment). Insulator washers 90 screw onto the insulator pipe 91 which is threaded on the outside. These insulator washers 90 secure the insulator pipe 91 to the housing 10 in an airtight manner. The insulator 20 is designed to allow an electrical conductor wire 92 to pass through the housing 10 without allowing air to escape. Surrounding the wire 92 is a ceramic insulator body 93. The insulator body 93 fits inside the insulator pipe 91 and is secured therein by washer 94 and a pair of threaded caps 95 which screw onto either end of the insulator tube 91. In the specific embodiment under consideration, the insulator body 93 is 3 inches in diameter at its widest part and 2 ½ inches in diameter at the ends. A pair of insulator caps 96 fit over either end of the insulator body 93 to provide an airtight seal between the insulator body 93 and the wire conductor 92. Both the threaded caps 95 and the insulator caps 96 have central circular apertures therein through which allow passage therethrough of the insulator body 93 and the wire conductor 92.

Figure 9:
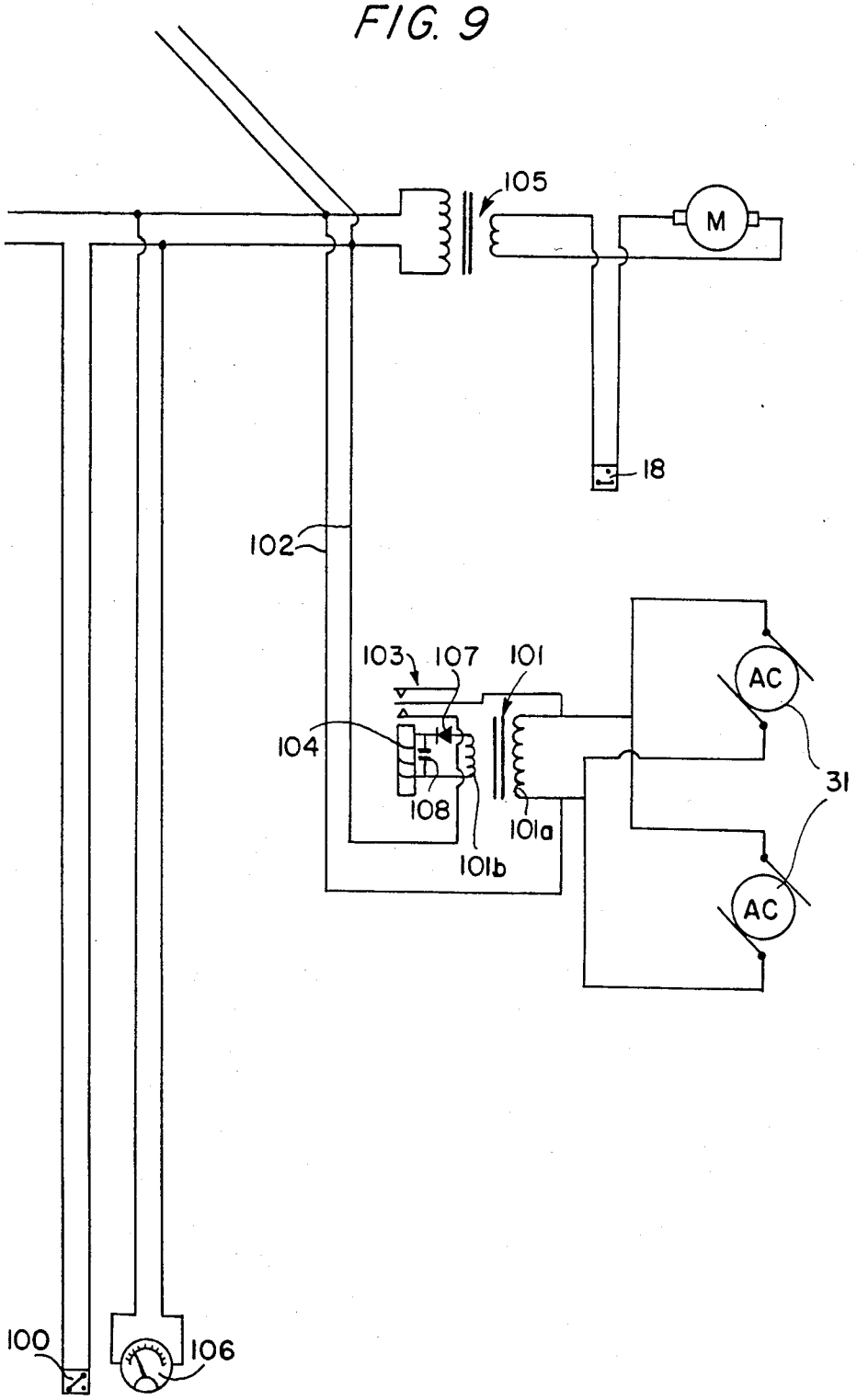
FIG. 9 is a schematic circuit diagram of a preferred embodiment of the electrical system associated with the power generating unit of the present invention.

Referring now to FIG. 9, the electrical system of the present invention includes a pair of parallel connected generators 31 which correspond to those discussed above and which are connected to the primary winding 101*a* of a step down transformer 101. The generators 31 are also connected to an output line 102 through a relay switch 103. The secondary winding 101*a* of transformer 101 is connected to the relay armature coil 104 through a diode 107 and a shunt capacitor 108. The diode 107 provides half-wave rectification by blocking one half of each A.C. cycle to produce, in cooperation with capacitor 108, a rectified D.C. waveform. The purpose of capacitor 108 is to maintain the D.C. voltage by discharging on each suppressed half cycle. With relay switch 103 closed, voltage is supplied from generators 31 to output line 102. The electrical system also includes is an electric motor 104 which is used to run the compressor 11 and which is connected to the system through a second step-down transformer 105 and the float switch 18. The electrical system also includes a meter 106 for enabling reading of the output of the generators 31 and a manual control switch 100 which is connected in series with an external power source (not shown).

In operation, the manual switch 100 is activated by an operator to energize the motor 104 and activate the compressor 11. Once sufficient pressure is built up within the housing 10 to raise the water 16 up to the level of the float switch 18 the float switch 18 will open and shut off the motor 104 and, hence, de-energize the compressor 11. At this time the manual switch 100 is turned off and the outside power supply is thereby removed. The generators 31 will begin operating as a result of the pressurization of the chambers 12 and 13 in the manner described above and will thereafter generate sufficient voltage to activate (close) the relay switch 103 and the output line 102. Should the float switch 18 be activated, i.e., closed, by a lowering of the fluid 16 in the tube 17, the motor 104 will draw current over the output line 102 from the generators 31.

Figure 10:
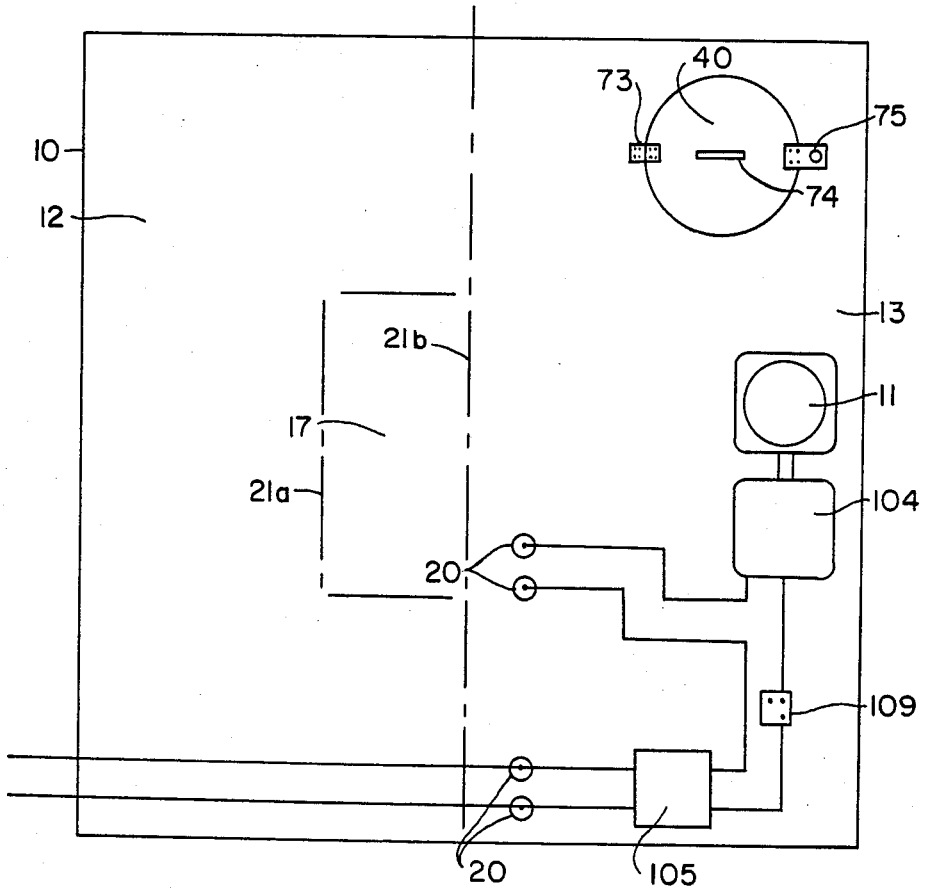
FIG. 10 is a top plan view of the unit showing selected components.

Referring now to FIG. 10 a plan view of the housing 10 provided which illustrates spatial relationship between the central tube or chamber 17 and the large chambers 12 and 13. In the specific embodiment under consideration, the cross-sectional area of chamber or tube 17 is 12 square feet whereas the overall cross-sectional area of the entire housing 10 is 625 square feet. As illustrated, four insulators 20 used in providing electrical connections to the portion of the system located within the housing 10. The electrical system also includes a switch 109 which is used by maintenance personnel to shut down the system prior to making repairs thereto.

In a alternate embodiment, the compressor 11 is replaced by a vacuum generator or vacuum source. In this embodiment, a vacuum is applied to the chambers 12 and 13 such that the water 16 will assume the same position as occupied in the pressure generator embodiment described previously. In order to apply a vacuum, only single valve unit (corresponding to unit 14), connected between the vacuum source and chamber 13 is needed. In this unit, an arrow-shaped valve corresponding to valve member 49 points downwardly rather than upwardly. This embodiment operates in a manner similar to that the pressurizing generator described above, except that the vacuum or negative pressure is applied only to the chamber 13 (rather than applying positive pressure to chambers 12 and 13) so as to cause the water in the central chamber 17 to rise to the desired level.

It should be understood that the hollow members 23 are not necessarily spherical in shape. These hollow members 23 may be of any suitable shape although in general, the shape should be one that minimizes drag in the direction of motion and at the same time maximizes the buoyancy. In one alternate embodiment, the leading end of the hollow members are conical in shape so that the apex of the cone points in the direction of movement of the member 23. In another embodiment, each member 23 is of generally rectangular shpae but includes a triangular leading end, pointing in the direction of movement.

In the specific non-limiting preferred embodiment of the invention being considered, the housing 10 is 100 feet high and each side of the housing 10 is 25 feet long so that the overall cross-sectional area is 625 feet as set forth above. The wall 21*b* divides the interior of the housing 20 in half and the central chamber 17 located on one side of the wall 21*b* is 96 feet high. The cross-sectional dimensions of chamber 17 are 3 feet by 4 feet. Partition 21*a* extends to within 3 feet of the bottom of the housing 10 so as to allow passage of fluid thereunder, as described above. In operation, the housing 10 is filled with 7 feet of fluid and when pressure or vacuum is applied the fluid rises 96 feet up the chamber 17 and the water level in the housing 10 drops to approximately 5 feet. In the preferred embodiment, two rows of 158 hollow spheres 23 attached to the chain 24 for a total of 316 spheres. There is a 3 inch vertical space between each sphere 23 and each sphere is 1 foot in diameter. The rows of spheres 23 are 1 foot apart horizontally. The chain drive 24 is 197 feet long and the small gears 31*a* and 31*b* are 3 ½ inches in diameter.

Although the present invention has been described relative to exemplary embodiments thereof, it will be understood by those skilled in the art that variations and modifications can be effected in these exemplary embodiments without departing from the scope and spirit of the invention.

What is claimed:

1. A bouyancy and gravity actuated apparatus for generating electrical power, said apparatus comprising:

a housing divided into first and second chambers by a partition which extends to the top of said housing and is spaced a predetermined distance from the bottom of said housing, said housing containing a liquid therein;

a further vertical chamber located within said first chamber;

means for producing pressure within the housing, the amount of liquid within the chamber being of sufficient volume such that, when a pressure is produced in the chamber, said vertical chamber is filled to the top thereof and the overall level of the liquid within the housing is above the bottom edge of said partition;

an endless flexible carrier extending vertically through the liquid contained in said vertical chamber, through the partition, vertically through an air space defined in said second chamber above the liquid and beneath the partition through the liquid contained at the bottom of the housing;

a plurality of buoyant elements spaced along the length of said flexible carrier;

means for mounting said flexible carrier so as to permit movement thereof in response to said bouyant elements rising due to their bouyancy in said chamber and falling by gravity in said air space; and means responsive to the movement of said flexible carrier for generating electricity.

2. An apparatus in accordance with claim 1 wherein said means for producing said predetermined pressure within said housing comprises at least one valve passing through the top of said housing above, and a means connected to the second chamber through said valve for applying a negative pressure within said second chamber.

3. An apparatus in accordance with claim 1 wherein said means for producing a predetermined pressure within said housing comprises:

a first valve passing through said housing into said first chamber;

a second valve passing through said housing into said second chamber; and a means connected through said first and second valves to said first and second chambers for producing a positive pressure in said first and second chambers.

4. An apparatus in accordance with claim 3 further comprising: a hatch in the top of said housing for allowing entry of workmen into the housing for routine maintenance and repair.

5. An apparatus in accordance with claim 4 further comprising a float switch located at the top of said vertical chamber for shutting off said pressure producing means when the fluid level in the vertical chamber reaches a preselected height.

6. An apparatus in accordance with claim 5 wherein said electricity generating means is located within said housing and said apparatus further comprising at least one electrical connector for connecting said electricity generating means to to a terminal outside of said housing, and at least one electrical insulator for providing an airtight passage through said housing through which said electrical connector passes.

7. An apparatus in accordance with claim 6 wherein said liquid comprises water.

8. An apparatus in accordance with claim 7 wherein said electricity generating means comprises at least one alternating current generator.

9. An apparatus in accordance with claim 3 wherein a plurality of valves are provided and each of said valves comprises:

a tubular member extending through said housing, means for attaching the tubular member to the housing;

a first circular plate having a conical aperture therein;

a second circular plate having a cylindrical aperture in the center thereof and at least one other aperture therein for allowing the passage of fluids through said second plate;

an arrow-shaped member having a shaft journalled in said cylindrical aperture of said second plate and a conical head which fits snugly in said conical aperture in said first plate, and a spring member, surrounding said shaft and extending between said second plate and said conical head, for biasing said head into engagement with said conical aperture in said first plate.

10. An apparatus in accordance with claim 9 wherein said buoyant elements are spherical in shape.

11. An apparatus in accordance with claim 9 wherein said buoyant elements include a shaped leading edge in the direction of the movement thereof through said liquid which enhances said movement through said liquid.

12. An apparatus in accordance with claim 5 wherein said hatch comprises:

a generally circular doorframe disposed in an opening said housing;

a convex door attached to said doorframe, and a means for releasing the pressure in said housing so as prevent the opening of said door prior to the release of the pressure contained in said housing.

13. An apparatus in accordance with claim 12 wherein said pressure releasing means the comprises:

a hasp attached to said door, and a screw, in engagement with said hasp and screwed into an opening in said housing, including a slot therein which allows the pressure inside the housing to be released outside the housing when said screw is partially unscrewed.

14. An apparatus in accordance with claim 2 further comprising a hatch in the top of said housing to allow entry of workmen for routine maintenance and repair.

15. An apparatus in accordance with claim 14 further comprising a float switch located at the top of said tube for shutting off said means for applying pressure when the fluid level in the vertical chamber reaches a preselected height.

16. An apparatus in accordance with claim 15 further comprising electrical wiring connected to said means for generating electricity to convey the electricity outside said housing, and at least one electrical insulator for providing an airtight passage through said housing through which said electrical wiring passes.

17. An apparatus in accordance with claim 16 wherein said fluid is water.

18. An apparatus in accordance with claim 17 wherein said means for generating electricity comprises at least one alternating current generator.

19. An apparatus in accordance with claim 18 wherein said at one valve comprises:

a pipe attached to said housing and passing therethrough, a first circular plate having a conical aperture therein;

a second circular plate having a cylindrical aperture in the center and at least one other aperture therein for allowing the passage of fluids through said second plate;

an arrow-shaped member having a shaft journalled in said cylindrical aperture of said second plate and a head which fits snugly in said conical aperture in said first plate, and a spring-like member wrapped about said shaft having one end in contact with said second plate and the other end in contact with said head such that said spring-like member biases said head into engagement in said conical aperture in said first plate.

20. An apparatus in accordance with claim 19 wherein said buoyant elements are spherical in shape.

21. An apparatus in accordance with claim 19 wherein said buoyant elements comprise a shaped leading edge facing in the direction of their movement through said fluid.

22. An apparatus in accordance with claim 21 wherein said hatch comprises:

a generally circular doorframe disposed in an opening in said housing;

a convex door attached to said doorframe, and a means for releasing the pressure in said housing so as to prevents the opening of said door prior to the release of the pressure contained in said housing.

23. An apparatus in accordance with claim 22 wherein said means for releasing the pressure comprises:

a hasp attached to said door, and a screw, in engagement with said hasp and screwed into an opening in said housing including a slot therein which allow the pressure inside the housing to be released outside the housing when said screw is partially unscrewed.

* * * * *